United States Patent [19]

Dugan

[11] Patent Number: 4,742,788

[45] Date of Patent: May 10, 1988

[54] MATTRESS PAD AND FITTED BED SHEET

[75] Inventor: Jeffrey S. Dugan, Matthews, N.C.

[73] Assignee: Springs Industries, Inc., Fort Mill, S.C.

[21] Appl. No.: 78,513

[22] Filed: Jul. 27, 1987

Related U.S. Application Data

[62] Division of Ser. No. 805,319, Dec. 4, 1985, Pat. No. 4,682,379.

[51] Int. Cl.[4] ..... D05B 1/00

[52] U.S. Cl. ..... 112/262.1; 112/262.2; 112/10; 112/121.26; 112/104

[58] Field of Search ..... 112/262.2, 262.1, 262.3, 112/265.1, 10, 121.26, 104; 5/500, 502, 497, 498, 496, 499

[56] References Cited

U.S. PATENT DOCUMENTS

| | | | |
|---|---|---|---|
| 1,334,901 | 3/1920 | Higdon | 5/500 |
| 1,867,425 | 7/1932 | Swetzel | 5/499 X |
| 2,516,363 | 7/1950 | Block et al. | 5/500 |
| 2,963,715 | 12/1960 | Young | 5/497 |
| 3,208,419 | 9/1965 | Frydryk | 112/262.2 |
| 4,301,561 | 11/1981 | McLeod | 5/496 |
| 4,594,956 | 6/1986 | Vartoukian et al. | 112/262.1 |
| 4,651,370 | 3/1987 | Vitale | 5/502 X |
| 4,682,555 | 7/1987 | Bierbaum et al. | 112/262.3 X |

*Primary Examiner*—H. Hampton Hunter
*Attorney, Agent, or Firm*—Thomas & Kennedy

[57] ABSTRACT

The fitted bed sheet (22) and mattress pad (30) are connected together along the side edges (47 and 48) of the pad by stitching (49). The length of the pad and bed sheet are the same so that the foot and head portions (32 and 33) of the pad extend into and form a part of the foot and head skirts (25 and 26) of the pad-sheet (20). An elastic hem (35 and 36) is formed about the edges of the skirt at the foot and head of the pad-sheet.

8 Claims, 3 Drawing Sheets

MATTRESS PAD AND FITTED BED SHEET

This is a division of co-pending application Ser. No. 805,318, filed on Dec. 4, 1985, now U.S. Pat. No. 4,682,379, issued July 28, 1987.

FIELD OF THE INVENTION

This invention relates to the combination of a fitted bed sheet and mattress pad which are permanently attached to each other and can be fitted to or removed from a mattress simultaneously, and further relates to a process for manufacturing the fitted bed sheet and mattress pad.

BACKGROUND OF THE INVENTION

Mattress pads have been in common use for placement between the top surface of a mattress and a bed sheet, so as to shield the mattress from becoming soiled and to provide extra comfort to the person sleeping on the bed. Typically, the mattress pads include a skirt or other connection means that fits about the corners of the mattress so as to hold the mattress pad in position on the bed. Then the fitted or "contoured" bottom bed sheet is placed about the mattress over the mattress pad, with its skirt placed about the mattress.

The use of separate bed sheets and mattress pads requires the individual production of two separate objects that are used together on a bed. Moreover, the separate construction of the bed sheet and mattress pad sometimes results in the mattress pad becoming wrinkled or displaced from proper position between the sheet and the mattress, which is likely to cause some discomfort to the person sleeping on the bed. Also, as the mattress pad and bed sheet are used and laundered over an extended period, they tend to change shapes, usually with the mattress pad shrinking slightly so that it no longer corresponds to the shape of the bed sheet or to the shape of the mattress. The mattress pad and bed sheet are purchased separately, put on and removed from the mattress separately, and are stored separately.

It would be desirable to construct a combination fitted bed sheet and mattress pad simultaneously so as to minimize the steps required to make these items, and thereby reduce the cost of production. In addition, it would be desirable to provide a combination fitted bed sheet and mattress pad whereby the mattress pad is permanently connected to the bed sheet and tends to retain a shape that corresponds to the bed sheet, and both the bed sheet and mattress pad can be simultaneously fitted to or removed from the mattress.

SUMMARY OF THE INVENTION

Briefly described, the present invention comprises a combined fitted or contoured bottom bed sheet and mattress pad which are permanently connected together, and a process of fabricating the combined bed sheet and mattress pad.

In one form of the invention a bed sheet and a mattress pad are cut to equal lengths and placed in overlying relationship, with the narrower mattress pad centered between the side edge portions of the bed sheet. The mattress pad is sewn at its side edges to the bed sheet, with the overlapping side portions of the the bed sheet forming side skirts along opposite sides of the mattress pad that will fit about the mattress. Notches are formed at the corners of the bed sheet, and the head and foot portions of the bed sheet and mattress pad are sewn at the notches to the side skirts of the bed sheet. An elastic hem is formed about the cut head and foot edges of the bed sheet and mattress pad.

The combined bed sheet and mattress pad includes in its skirts at both the head and foot of the mattress a length of mattress pad material, with the mattress pad sewn at all four of its edge portions to the bed sheet. This assures permanent connection of the mattress pad to the bed sheet and tends to cause the mattress pad to retain a shape that corresponds to the sleeping surface of the bed sheet. Moreover, should the mattress pad shrink during laundering, the elastic hems at both the head and foot of the bed sheet tend to stretch the mattress pad lengthwise about the mattress. The tension applied by the elastic hem at both the head and foot of the bed sheet tends to apply tension to the lower selvage of the skirt of the bed sheet, which further tends to stretch the bed sheet across the length of the mattress, tending to pull the bed sheet and mattress pad taut, resulting in both a smooth top surface of the bed sheet and a smooth mattress pad beneath the bed sheet.

Generally, the combined fitted bed sheet and mattress pad are considered by some people to be more comfortable than the separate pad and sheet, and when the sheet of the combined bed sheet and mattress pad is to be laundred, the mattress pad also must be laundered, resulting in improved hygiene in those situations in which a separate pad might not be laundered when its sheet is laundered.

Thus, it is an object of this invention to provide a combined mattress pad and fitted bed sheet for use on a mattress, which is expedient to produce and which is convenient to fit to and remove from a mattress, and which tends to prolong the useful life of the mattress pad.

Another object of this invention is to provide a process of making a combined fitted bottom bed sheet and mattress pad which reduces the number of steps required to make a mattress pad and bed sheet and which forms an improved product.

Other objects, features and advantages of this invention will become apparent upon reading the following specification, when taken in conjunction with the accompanying drawings.

DETAILED DESCRIPTION

Figure 1:
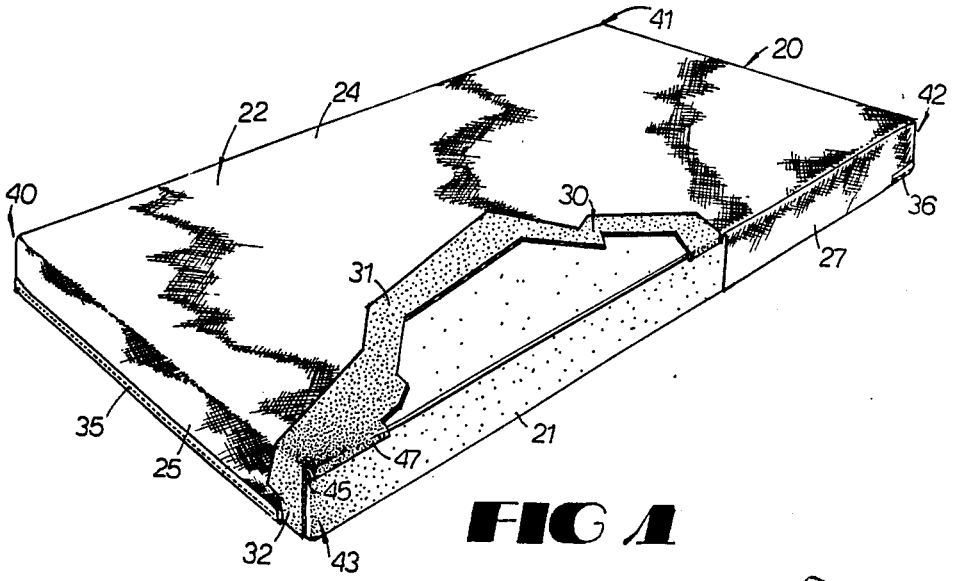
FIG. 1 is a perspective illustration of the bed sheet and mattress pad combination, showing the product fitted to a mattress, with a portion of the bed sheet and a portion of the mattress pad removed to illustrate some of the features of the construction.

Referring now in more detail to the drawings, in which like numerals indicate like parts throughout the several views, FIG. 1 illustrates a mattress pad and fitted bed sheet combination 20 that is mounted to a rectangular mattress 21 of conventional construction. The mattress pad and bed sheet combination, hereinafter referred to as pad-sheet, includes a bed sheet 22 having a top ply 24 that spans the top surface of the mattress 21 and corresponds in size and shape to the top surface of the mattress, and a continuous skirt formed of a foot skirt 25, a head skirt 26 (FIG. 10), and opposite side skirts 27 and 28. The skirts 25–28 correspond in size and shape to the side surfaces of the mattress.

Mattress pad 30 also includes a top ply 31 that corresponds in size and shape to the top surface of the mattress as well as to the size of the top ply 24 of the bed sheet, and also includes continuations of the top ply that extend downwardly to form foot and head skirts 32 and 33. The mattress pad does not include side skirts.

Figure 3:
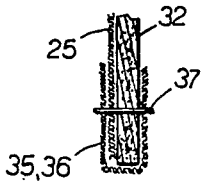
FIG. 3 is a schematic representation of the hem and stitching formed by the folded elastic band at the lower edge of the skirts at the head and foot of the bed sheet and mattress pad, taken along lines 3—3 of FIG. 2.

The mattress pad 30 is of substantially equal length as the bed sheet 22, with the foot and head portions 32 and 33 of the mattress pad forming the foot and head skirts 32 and 33 that extend about the foot and head surfaces of the mattress. An elastic band 35, formed from a material known as "Lycra", is folded along its length into a hem shape and is inserted about the aligned edges of the foot portions of the bed sheet and of the mattress pad and is sewn thereto with stitching 37 (FIG. 3). Likewise, a similar elastic band 36 is folded about the aligned edges of the mattress pad and of the bed sheet at the head of the pad-sheet and sewn thereto with similar stitching. The opposite end portions of the elastic bands 35 and 36 extend into overlying relationship with respect to the side skirts 27 and 28 of the bed sheet and are also sewn thereto. The bands 35 and 36 are stretched as they are sewn to the pad-sheet, so that the bands apply tension to and tend to gather the foot skirt and head skirt of the pad-sheet. This construction provides the necessary stretchable lower margin of the fitted pad-sheet which permits the pad-sheet to be fitted about the mattress and also tends to pull both the bed sheet and the mattress pad into a stretched, conforming shape about the mattress.

Figure 2:
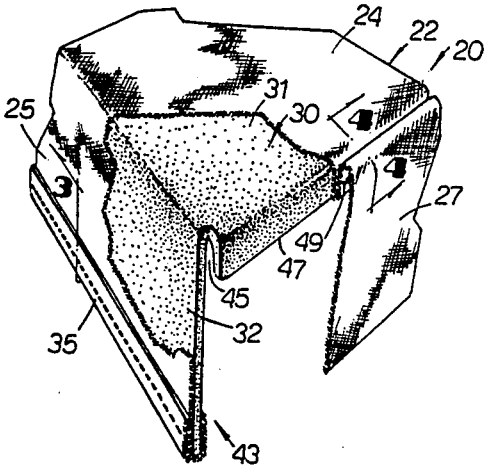
FIG. 2 is a detailed illustration of a corner portion of the combined fitted bed sheet and mattress pad.
Figure 9:
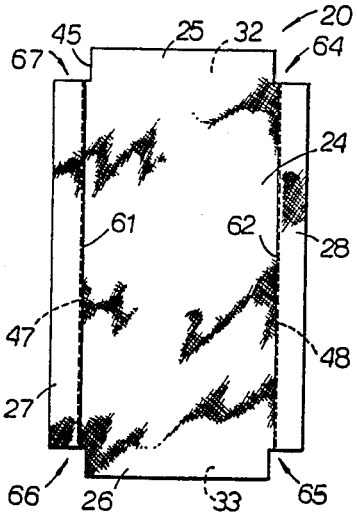

In order to form the corner structures 40, 41, 42 and 43 in a smooth configuration the foot and head skirts 32 and 33 of the mattress pad are cut to a smaller width, forming notches such as the notch illustrated at 45 at the corner structure 43 (FIGS. 2 and 9).

Figure 4:
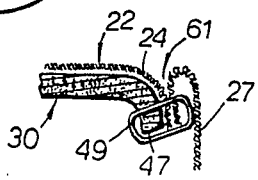
FIG. 4 is a schematic representation of the hem and stitching formed between the side skirt of the bed sheet and the top ply of sheeting material of the bed sheet and the side edge of the mattress pad, taken along lines 4—4 of FIG. 2.

The top ply 24 of the bed sheet 22 is sewn to the side edges 47 and 48 of the mattress pad by stitching 49 (FIG. 4). Also, the side skirts 27 and 28 are attached to the top ply 24 of the bed sheet by the same stitching 49.

Figure 5:
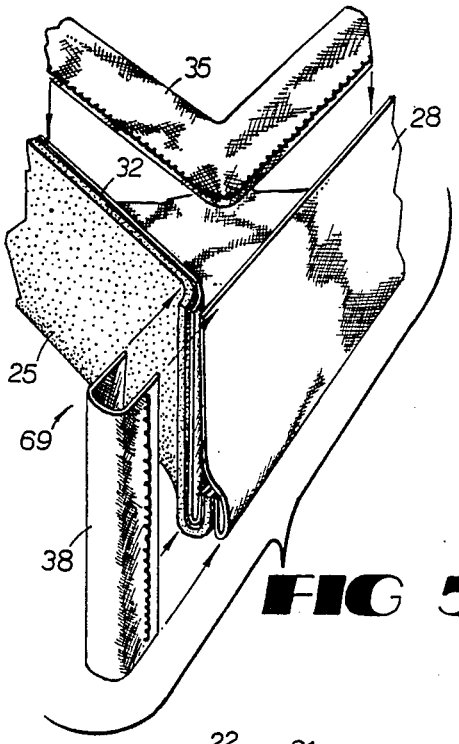
FIG. 5 is an exploded illustration of one everted corner of the bed sheet and mattress pad, showing how the hem is formed by a folded elastic band placed about the edges of the sheet and pad material.
Figure 10:
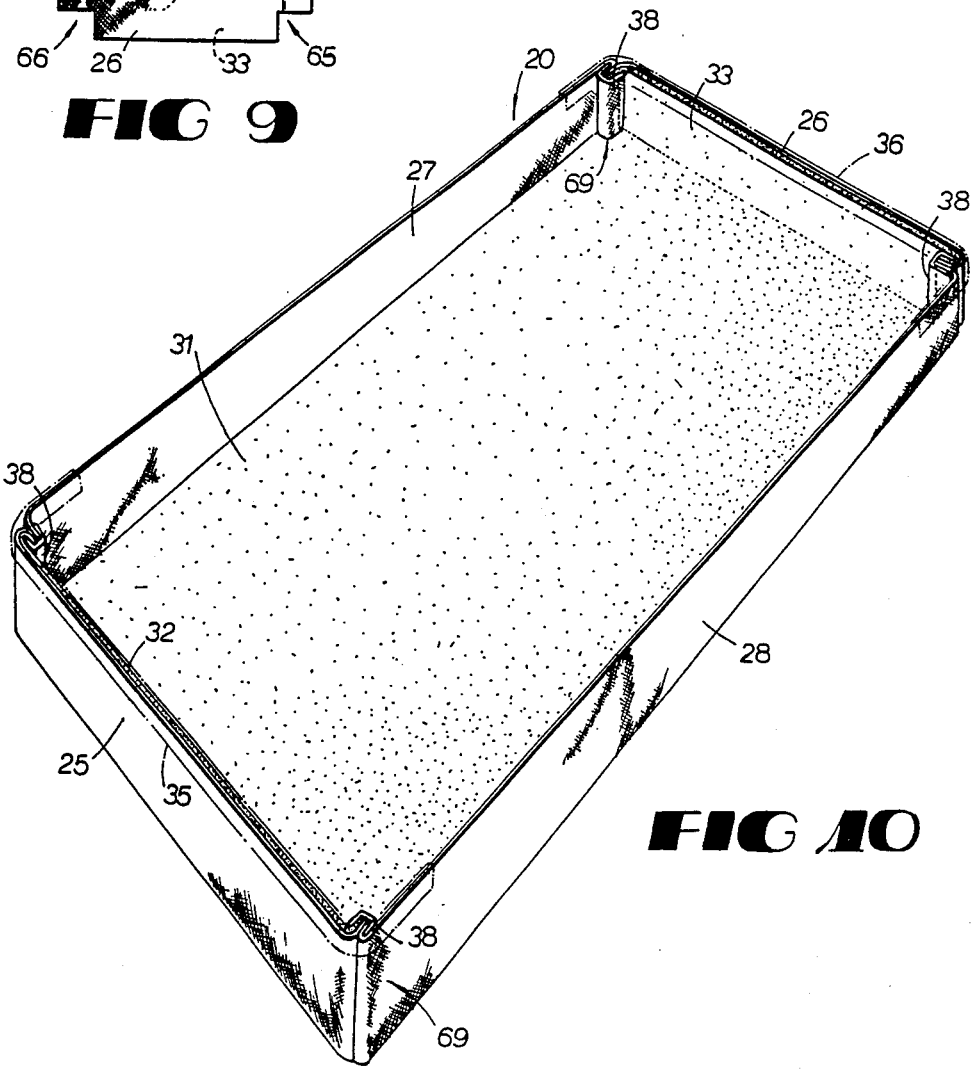

As illustrated in FIG. 5, each corner of the pad-sheet is formed by a strip 38 of the elastic band material being folded about and sewn to the overlying edges of the skirts of the bad-sheet when in an everted configuration. The folded bands 35, 36 are later sewn to the aligned edges of the bed sheet and mattress pad so as to cover the end of strip 38 (FIGS. 5 and 10).

THE PROCESS OF FORMING THE PAD-SHEET

Figure 6A:
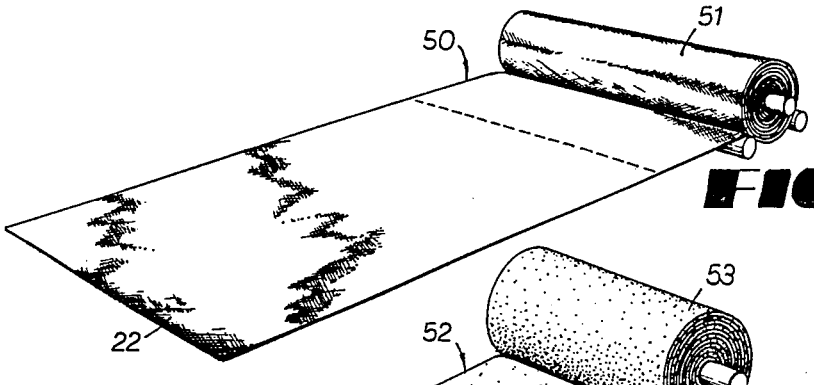
FIGS. 6A, 6B and 7–10 are progressive schematic illustrations of the process by which the combined mattress pad and fitted bed sheet are produced, with FIG. 10 showing the mattress pad and sheet inverted and the elastic hems shown in phantom lines to illustrate the construction of the skirt edges.
Figure 6B:
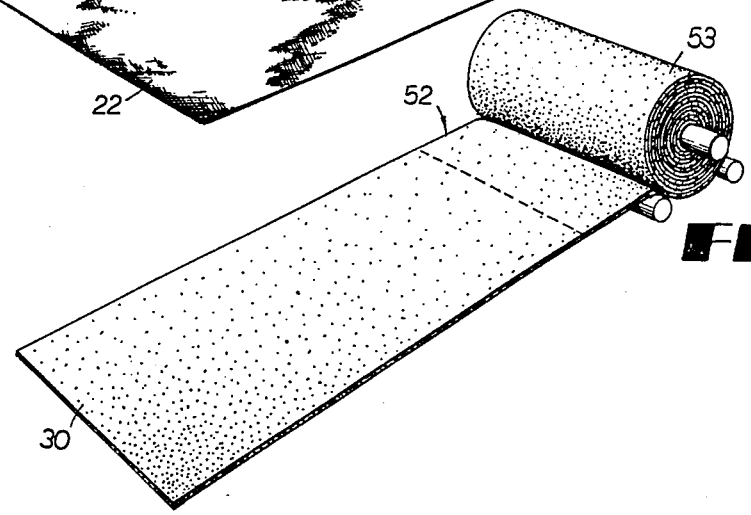

As schematically illustrated in FIGS. 6A and 6B, bed sheet material 50 is fed from a reel or other supply 51 and is cut to length to form the bed sheet 22, and mattress pad material 52 is fed from a similar reel, box or other supply 53 and cut to length to form the mattress pad 30. The sheet material 50 can be of any commonly used bed sheet material, such as a blend of cotton and polyester. Likewise, the mattress pad material 2 generally will be formed of conventional material such as a fibrous filling formed in a layer between a pair of woven sheets. In general, the mattress pad 30 will receive length and width stability from the relatively unstretchable bed sheet 22.

Figure 7:
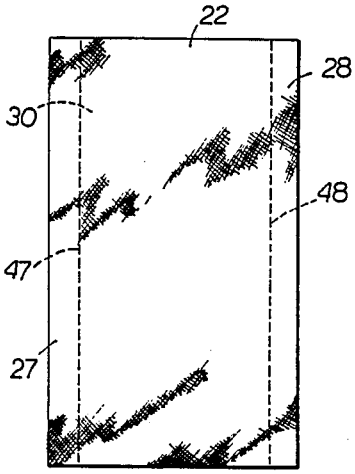
Figure 8:
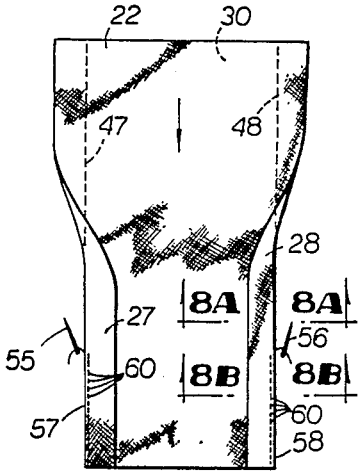

The mattress pad material 52 which is drawn from its supply 53 is of smaller width than the bed sheet material 50, but both the bed sheet material and mattress pad material are cut in approximately equal lengths and are placed in overlying relationship (FIG. 7), with the mattress pad 30 centered beneath the sheet, with the head and foot edges of the bed sheet and mattress pad aligned, and with the side skirts 27 and 28 of the bed sheet overhanging the side edges 47 and 48 of the mattress pad. The mattress pad and bed sheet are then moved along their lengths (FIG. 8) through sewing stations where sewing machines 55 and 56, as represented by the needles, sew the bed sheet and mattress pad together. Although the sewing steps are illustrated in FIG. 8 as if they are being performed simultaneously, these steps usually are performed in series so as to avoid the requirement of special sewing equipment. Prior to the sewing steps along the edges of the mattress pad, the side skirts 27 and 28 of the bed sheet are folded back over the middle portion of the bed sheet, so as to form folds 57 and 58 that the aligned with the side edges 47 and 48 of the mattress pad. The sewing machines 55 and 56 are the type that form overedge stitching and which trim the material that is to be sewn so as to accurately form the edges that are about to be sewn together.

Figure 8A:
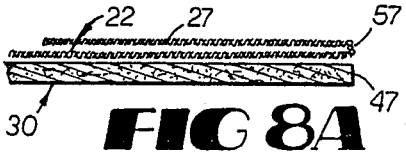
FIGS. 8A and 8B are detail illustrations of the one side edge portion of the mattress pad, demonstrating how the side portions of the bed sheet are folded and overedge stitching is formed to connect the bed sheet and mattress pad, with FIG. 8A taken along lines 8A—8A of FIG. 8, and with FIG. 8B taken along lines 8B—8B of FIG. 8.

As illustrated in FIG. 8A, each fold, such as fold 57 in the bed sheet, is aligned with the side edge 47 of the mattress pad, but when the overedge stitching 60 is sewn into the aligned edges, the sewing machine cuts the fold 57 so that the stitching 49 (FIG. 8B) is formed at the cut edges of the top ply 24 of the bed sheet and of the side skirt 27. With this type of folding, cutting and stitching, the skirt 27 will be folded back in a downward direction (FIG. 4), and the cut edges of the mattress pad, top ply of the bed sheet and of the skirt will be hidden from view and a neat seam 61 (FIG. 4) will be observed along the sides of the top ply 24 of the bed sheet.

As illustrated in FIG. 9, notches 64, 65, 66 and 67 are formed at the corners of the otherwise rectangular bed sheet, with the notches reaching through the end portions of the side skirts 27 and 28 and on beyond the side seams 61 and 62, and to a short distance into the mattress pad. This forms the mattress pad notch 45 that appears at each corner of the mattress pad (FIGS. 1, 2 and 9).

FIG. 10 illustrates the pad-sheet 20 in an inverted configuration. The foot portion 25 and head portion 26 of the bed sheet, as well as the foot portion 32 and head portion 33 of the mattress pad, are folded to a 90 degree angle with respect to the top ply of the bed sheet, and the edges formed by the notches 64–67 (FIG. 9) are sewn together, as represented by seam 69 in FIGS. 5 and 10, by forming a strip 38 of the elastic material in a U-shape fold about the edges of the bed sheet and mattress pad and sewing through the overlying layers. This causes the foot skirts 25 and 32, head skirts 26 and 33 and side skirts 27 and 28 to be formed in a continuous downwardly extending skirt from the peripheral edges of the top plys 24 and 31 of the pad-sheet 20.

As illustrated in FIGS. 1, 3, 5 and 10 the elastic hems 35 and 36 are then sewn to the skirts of the pad-sheet 20, by folding a length of elastic band material about the cut edges of the bed sheet and mattress pad and sewing through the folds of the elastic band material and the end portions of the bed sheet and mattress pad, to form an elastic hem. The elastic band material is stretched as it is sewn, and this provides the elasticity at the lower portion of the continuous skirt of the bed sheet and enables the skirt to be stretched as it is fitted about the mattress, and tends to stretch the bed sheet and mattress pad into a conforming shape with respect to the mattress. The elastic hems 35 and 36 also extend over the end of seam 69 at the corners of the pad-sheet 20.

While the invention has been described a utilizing a fiber filled mattress pad material as the mattress pad, it should be obvious to those skilled in the art that the mattress pad material can comprise other materials, including foam rubber sheet material, sliver knit, rubber sheet material or other waterproof sheet material. Moreover, the mattress pad can be formed with a metalized layer as a part of the fiber fill or other sheet layer so as to form a heat reflective surface with the mattress pad, for the purpose of reflecting body heat and heat from other sources. Moreover, it is within the perview of this invention to form the mattress pad material of a width equal to the width of the entire bed sheet material, so that the side skirts of the pad sheet include both sheet material and pad material.

Although FIGS. 6A and 6B illustrate the sheets and pads being cut separately and later matched together where they are to be sewn, another process for forming the pad-sheet is to advance the sheet material and pad material from their supplies into overlying relationship and cut through both layers of materials simultaneously along one cut line. With this process, the stitching of the layers of materials along the sides of the mattress pad material can be done either before or after the layers of materials are cut to length.

Figure 8B:
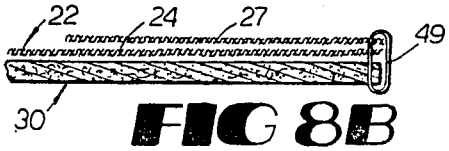

Although FIGS. 8, 8A and 8B disclose the procedure for forming an overedge stitch at the side edges of the mattress pad which connect the mattress pad to the bed sheet, applicant has developed an alternate procedure for connecting the materials together. The mattress pad material can be taken directly from its supply and an overedge stitch formed at its side edges. The mattress pad material and sheet material are then moved continuously together and a conventional stitch is sewn through the edge of the mattress pad material and through the bed sheet material, which forms a continuous supply of the pad sheet material with side skirts of the bed sheet extending on opposite sides of the mattress pad. The combined pad sheet material is then cut to length, notched and sewn in the manner as previously described.

It should be understood that the just described embodiments merely illustrate principles of the invention in a preferred form. Many other modifications, additions and deletions may be made thereto without departure from the spirit and scope of the invention as set forth in the following claims.

I claim:

1. A process of making a fitted bed sheet and mattress pad combination comprising:

cutting approximately equal lengths of a rectangular bed sheet from a supply of bed sheet material and a rectangular mattress pad from a supply of mattress pad material with the mattress pad being of smaller width than the bed sheet, placing the bed sheet is overlying relationship with respect to the mattress pad with the head and foot edges of the bed sheet substantially aligned respectively with the head and foot edges of the mattress pad and with the mattress pad centered between the edge portions of the bed sheet to define side skirts of the bed sheet that extend beyond the side edges of the mattress pad for fitting about a mattress, folding the side skirts of the bed sheet over onto the central portion of the bed sheet with the folds aligned with the side edges of the mattress pad, sewing through the folds of the bed sheet and the side edges of the mattress pad to connect the mattress pad to the bed sheet, cutting notches in the bed sheet at its corners, and sewing the side skirts of the bed sheet at the notches to the head and foot portions of the mattress pad and bed sheet at the notches to form the head and foot portions of the mattress pad and bed sheet into head and foot skirts that fit about a mattress.

2. The process of claim 1 and further including the step of folding an elongated strip of elastic material along its length and about the aligned head edges of the bed sheet and mattress pad, and sewing through the folds of the elastic strip and the aligned head edges of the bed sheet and mattress pad, and folding another elongated strip of elastic material along its length and about the aligned foot edges of the bed sheet and mattress pad and sewing through the folds of the elastic strip and the aligned foot edges of the bed sheet and mattress pad.

3. The process of claim 1 and wherein the step of cutting notches in the bed sheet at its corners comprises simultaneously cutting notches in the mattress pad at its corners.

4. A process of making a fitted bed sheet and mattress pad combination comprising:

cutting approximately equal lengths of a rectangular bed sheet from a supply of bed sheet material and a rectangular mattress pad from a supply of mattress pad material, placing the bed sheet in overlying relationship with respect to the mattress pad with the head and foot edges of the bed sheet substantially aligned respectively with the head and foot edges of the mattress pad, sewing through the bed sheet and the side edges of the mattress pad to connect the mattress pad to the bed sheet, cutting notches in the bed sheet at its corners, and sewing the notched edges together to form foot, head and side skirts of the bed sheet that fit about a mattress.

5. The process of claim 4 and further including the step of folding an elongated strip of elastic material along its length and about the aligned head edges of the bed sheet and mattress pad, and sewing through the folds of the elastic strip and the aligned head edges of the bed sheet and mattress pad, and folding another elongated strip of elastic material along its length and about the aligned foot edges of the bed sheet and mattress pad and sewing through the folds of the elastic strip and the aligned foot edges of the bed sheet and mattress pad.

6. The process of claim 4 and wherein the step of cutting notches in the bed sheet at its corners comprises simultaneously cutting notches in the mattress pad at its corners.

7. A process of making a bed sheet and mattress pad combination comprising:

moving a length of bed sheet material and a length of mattress pad material in aligned overlying relationship, connecting the side edges of the mattress pad material to the bed sheet material, cutting the connected pad and sheet material to a predetermined length, and forming the corners of the bed sheet material into concave corner structures for fitting about the corners of a bed mattress.

8. The process of claim 7 wherein the step of moving the lengths of bed sheet material and mattress pad material in aligned overlying relationship comprises moving a mattress pad material of smaller width in overlying width-centered relationship with respect to the bed sheet material, and wherein the step of connecting the side edges of the mattress pad to the bed sheet material comprises connecting the side edges of the mattress pad to the bed sheet at positions displaced from the side edges of the bed sheet material.

* * * * *